United States Patent [19]

Girardelli

[11] Patent Number: 4,998,358

[45] Date of Patent: Mar. 12, 1991

[54] SIZE-ADJUSTABLE SKI BOOT

[75] Inventor: Helmut Girardelli, Oheregg, Switzerland

[73] Assignee: Aluxa AG, Liechtenstein, Liechtenstein

[21] Appl. No.: 395,084

[22] Filed: Aug. 17, 1989

[30] Foreign Application Priority Data

Aug. 22, 1988 [CH] Switzerland ..... 3114/88

[51] Int. Cl.[5] ..... A43B 5/04; A43B 5/16

[52] U.S. Cl. ..... 36/117; 36/120; 36/121

[58] Field of Search ..... 36/117–121, 36/97

[56] References Cited

U.S. PATENT DOCUMENTS

| | | | |
|---|---|---|---|
| 3,748,756 | 6/1973 | White | 36/97 |
| 3,922,800 | 12/1975 | Miller et al. | 36/97 X |
| 4,083,128 | 4/1978 | Rossman | 36/97 |
| 4,126,323 | 11/1978 | Scherz | 36/97 X |
| 4,178,925 | 12/1979 | Hirt | 36/97 X |
| 4,184,273 | 1/1980 | Boyer et al. | 36/117 X |
| 4,299,039 | 11/1981 | Hanson | 36/97 |
| 4,428,130 | 1/1984 | Perotto | 36/117 |

FOREIGN PATENT DOCUMENTS

| | | | |
|---|---|---|---|
| 2358117 | 3/1978 | France | 36/117 |

*Primary Examiner*—Paul T. Sewell
*Assistant Examiner*—BethAnne Cicconi
*Attorney, Agent, or Firm*—Stevens, Davis, Miller & Mosher

[57] ABSTRACT

The ski boot can be adjusted in length and/or width. The outer boot is divided into at least two shell parts, preferably into four shell parts (1, 2, 3, 4). The multi-part outer boot is individually adjustable at the front and back and has a predominantly supporting function. Insulation and sealing against moisture are ensured by a special, stretchable inner boot which is fitted to the foot size simutaneously with the adjustment of the outer boot.

14 Claims, 5 Drawing Sheets

SIZE-ADJUSTABLE SKI BOOT

Figure 1:
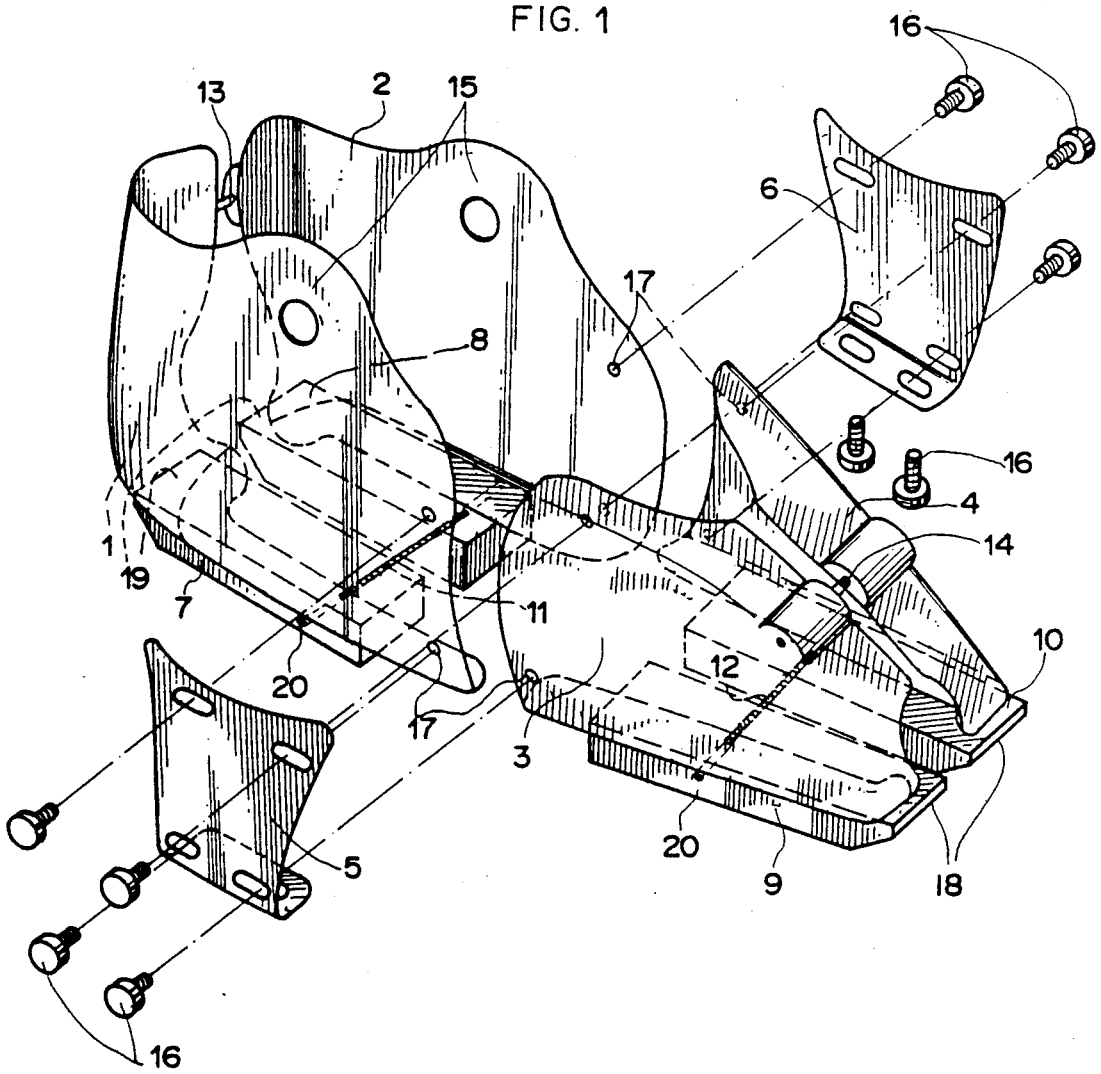

This invention relates to shell-type ski boots, and more particularly to a size-adjustable ski boot of the kind comprising an outer boot, a tiltable upper heel shell, an inner boot, and a fastening system.

Conventional ski boots must be provided in various sizes so that every skier can find his own shoe size. As a result, a number of different tools are needed during manufacture, and the trade must keep a relatively large stock on hand in order to satisfy the customers' demands. Frequently, therefore, a skier must select the model or brand of ski boot on the basis of the shape of his foot and may be severely restricted in his choice.

It is an object of this invention to provide an improved ski boot which remedies this problem in that it is adjustable in length and/or in width and can thus be precisely fitted to the most varied sizes and shapes of feet.

To this end, the ski boot according to the present invention, of the kind initially mentioned, comprises an outer boot divided for size adjustment in the direction of length and/or width.

The inventive ski boot is a shell-type boot intended to satisfy the requirements of both all-round skiers and racing competitors. It comprises an outer boot in the form of a shell divided into two or four parts parallel to and/or at right angles to the longitudinal axis of the boot. The contiguous boundary lines of these four shell parts are usually designed in such a way that when displaced relative to one another, they overlap within a certain range of adjustment. The contiguous or overlapping surfaces are so designed that penetration of snow and water is largely prevented. If the sole is integrated into the shell parts, there may be, between the front part of the sole and the heel, a gap which is broader or narrower depending upon the length adjustment. In this case, however, the parts of the outer boot situated above it must be interconnected in a sufficiently stable manner. For connecting and fitting the outer boot parts, adjusting means are used, such as setscrews or guide components in guide channels, by means of which the spacing of the individual parts can be precisely determined and fixed.

In the embodiment adjustable in length, the outer boot comprises a toe shell and a heel shell, preferably overlapping. The point of overlap may be so designed that it contains a gasket to prevent the penetration of water. Furthermore, in the embodiment adjustable in width, the two shells may be so designed that they are deformable in the adjustable region. Such deformability may be achieved by means of an overlap, a fold, a bellows-like construction, or a variable interstice.

Since a size-adjustable ski boot should likewise provide for adaptation of the position of the hinge between the upper and lower heel-shell parts, the inventive ski boot preferably has a vertically adjustable hinge. During adaptation of the size of the ski boot, the hinge must be fitted in accordance with the anatomical prerequisites. Once the height is correctly set, this hinge need no longer be adjusted by the skier. Consequently, it is possible to market such a boot in which the hinge is mounted in the correct position only at the time of fitting. For this purpose, the boot is prepared at the factory in such a way that the hinge can be easily mounted in various expedient positions.

The inventive ski boot likewise has a special inner boot which makes it possible to adapt the boot to a certain shoe size. The inner boot is preferably made of a stretchable and waterproof material. It is secured to the outer boot at the toe, at the heel, and at the edge of the boot. This may be done, for instance, by snapping a suitable plastic part of the inner boot into an opening in the outer boot. During the adjustment in length, the inner boot is stretched, without exerting pressure on the toes. The width of the inner boot must be such that the pressure on the foot is acceptable in the possible size ranges.

Figure 2:
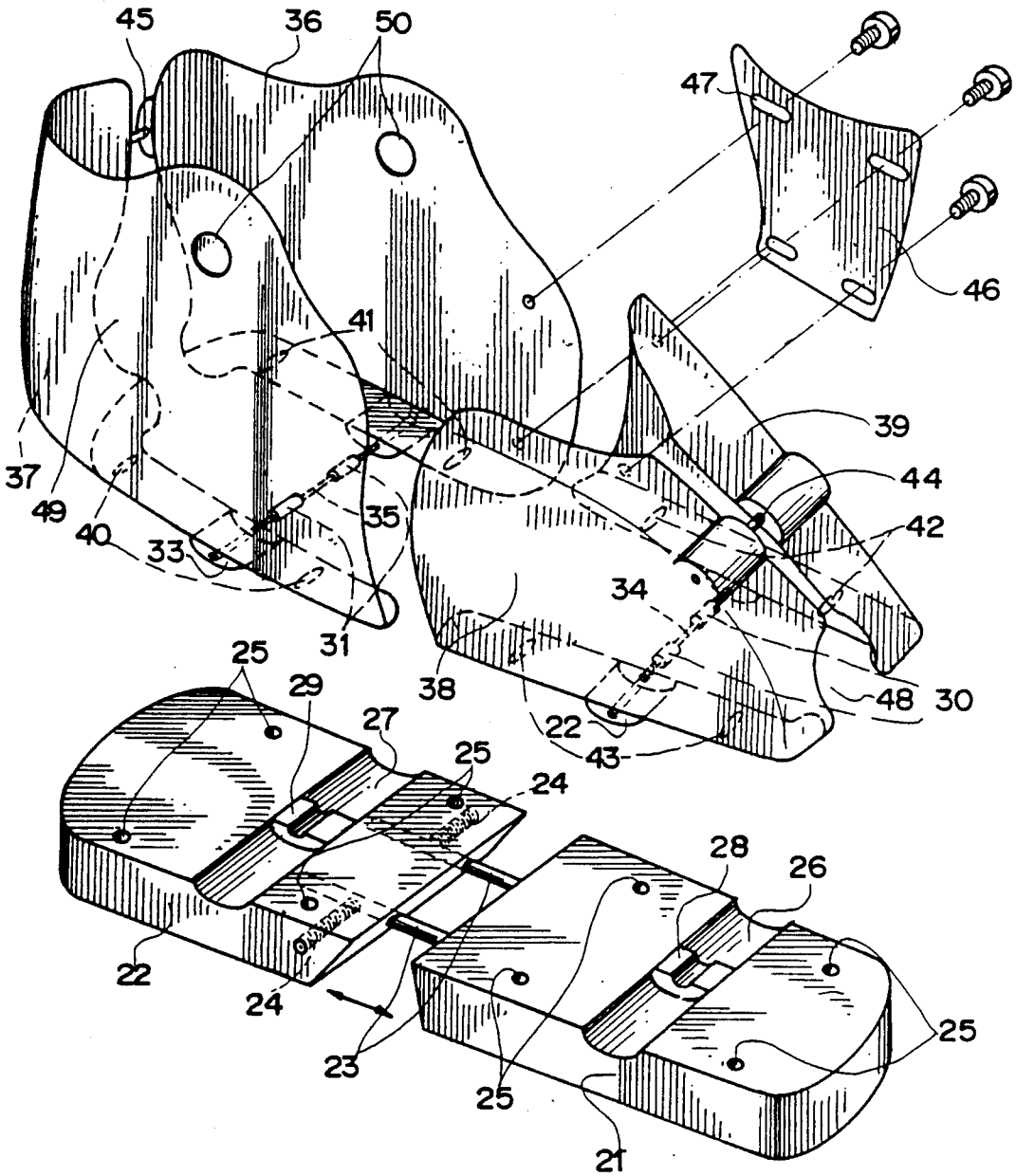
Figure 3:
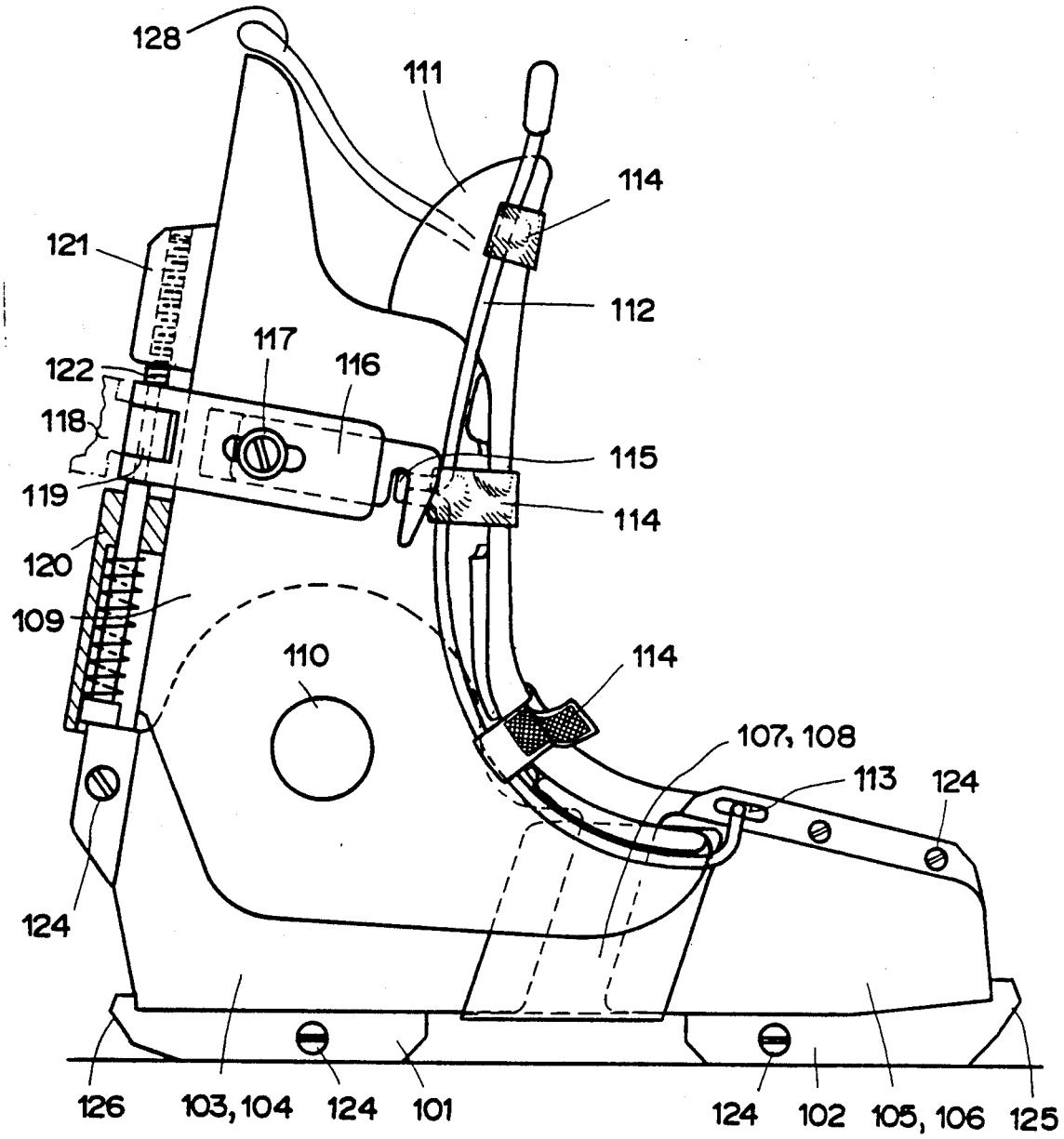
Figure 4:
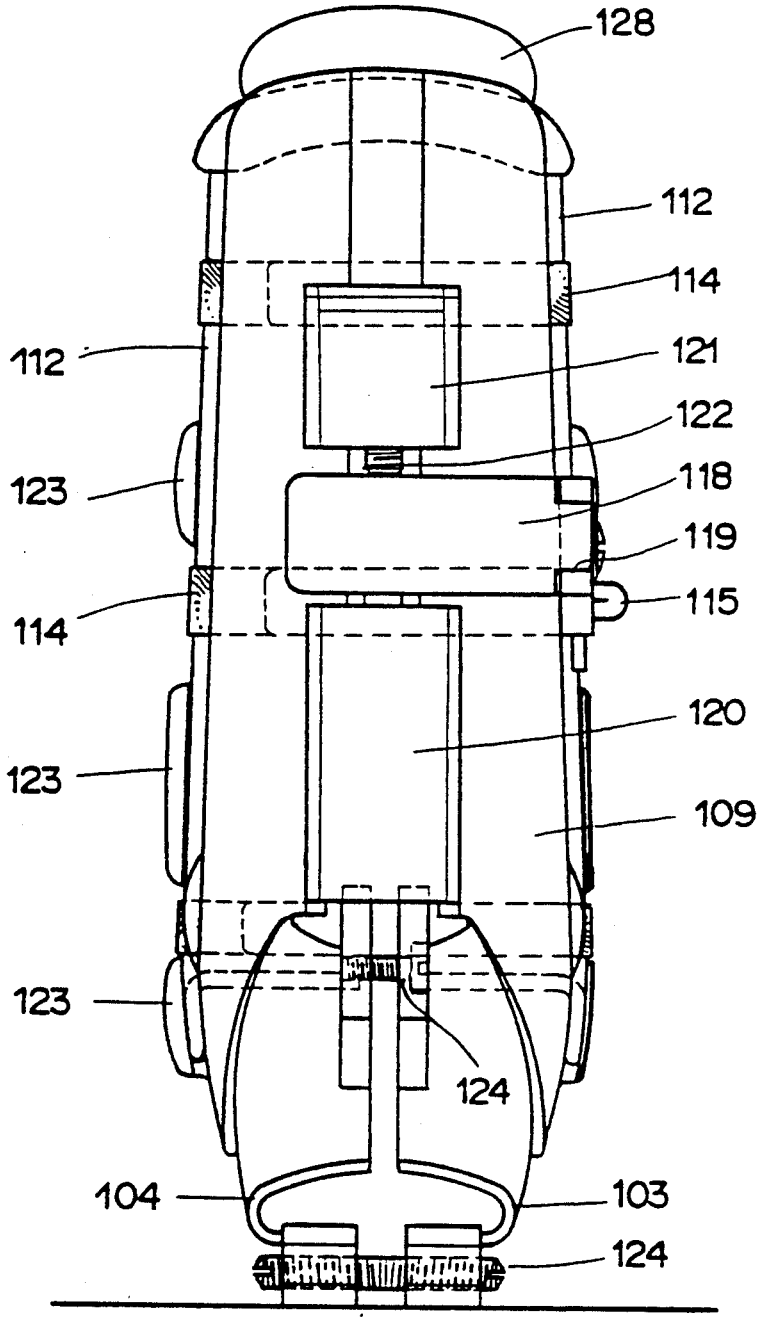
Figure 5:
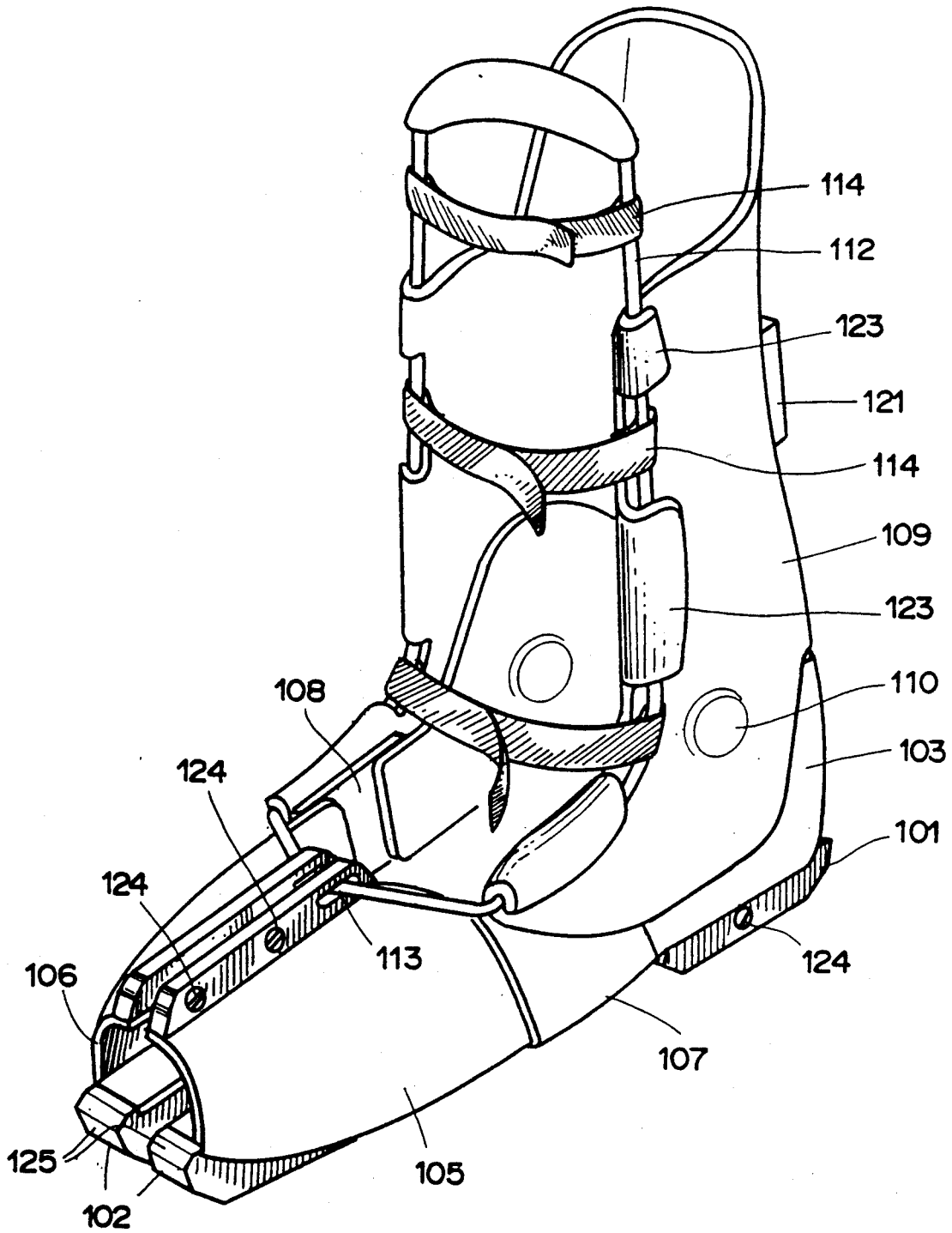

Preferred embodiments of the invention will now be described in detail with reference to the accompanying drawings, in which:

FIG. 1 is an exploded view of part of the outer boot of a ski boot adjustable in length and width in a first embodiment of the present invention, FIG. 2 is a similar view in a second embodiment having a separate sole, FIG. 3 is a side elevation of the inventive ski boot with a special fastening system, FIG. 4 is a rear elevation of the same boot, and FIG. 5 is a perspective view of the inventive boot without the inner boot.

An outer boot of an adjustable ski boot illustrated in FIG. 1 comprises an integrated sole composed of blocks 7, 8, 9, and 10, it being possible to secure adapter pieces to end faces 18 and 19. The load-bearing element of this ski boot is the outer boot comprising shell parts 1, 2, 3, and 4, preferably made of light metal and mutually displaceable both longitudinally and laterally. Laterally it is adjustable by means of setscrews 13 and 20, whereas longitudinally screws 16 are used for setting the correct length. Shell parts 1, 3 and 2, 4 are adjustably connected by cover elements 5 and 6, respectively. These cover elements may be omitted if parts 1, 3 and 2, 4 overlap. A tiltable upper heel shell (not shown) is secured to shell parts 1 and 2 at hinge locations 15.

FIG. 2 shows another embodiment of the inventive ski boot. This boot comprises a two-piece sole having a toe portion 21 and a heel portion 22. The two halves of the sole are connected by guide pins 23. The length of the sole is determined by means of setscrews 24 which may be disposed either in heel portion 22 or in toe portion 21. In the upper face of the sole there are attachment bores 25, preferably provided with internal threads, as well as guide grooves 26 and 27 for receiving setscrews 30, 31 of the outer boot, including matching attachment means 32, 33 provided with opposite internal threads. In grooves 26 and 27 there are guide means 28 and 29 for guiding setscrews 30 and 31 by means of guide grooves 34 and 35. Guide means 28 and 29 and matching grooves 34 and 35 in setting means 30 and 31 are likewise used for centering the outer boot relative to the sole. By means of this arrangement, an individual adjustment of the toe and heel halves can also be carried out.

The outer boot consists mainly of four shell parts 36–39. The sliding displacement of these parts relative to one another may be utilized for correct longitudinal and lateral adjustment. Shell parts 36–39 are attached to the sole by means of screws or rivets passing through elongated holes 40, 41, 42, 43 and the corresponding bores 25. This attachment should be just snug enough so that the shell parts are still laterally displaceable relative to the sole. Adjustment of the width of the ski boot takes place by means of the aforementioned setscrews 30 and 31 and additional setscrews 44 and 45. For lateral closure, cover plates 46 may be screwed on both sides as well, e.g., by means of screws passing through elongated holes 47. Alternatively, the lateral cover plates may instead be attached by means of special barbed plastic pins.

Since a watertight, elastic inner boot 128 is provided for the particular embodiment of the inventive ski boot, the outer boot need not be specially sealed against moisture. For attaching the inner boot 128, an opening 48 is provided at the toe and an opening 49 at the heel. Special plastic endpieces are provided for the inner boot 128, which can be inserted in these openings, The inner boot 128 is additionally secured by means of the edge of the upper heel shell, which is attached to lower heel shells 36 and 37 by hinges anchored in apertures 50. Either an adjustable or a fixed hinge may be used, although an adjustable hinge is preferred for adaptation to special foot shapes. The upper heel shell, not shown in FIG. 2, can be vertically adjustable so that the boot can be completely adapted to the size of the wearer. The ski boot also has attachment devices for affixing a closure flap (not shown), preferably to both the upper and lower heel shells. This flap is preferably so designed that faultless fitting to the wearer's foot is possible. This may be achieved, for example, by means of a double-walled flap, the spacing between the walls being individually adjustable.

The principle illustrated in FIG. 2 may naturally also be applied to ski boots having shell parts which are sealed relative to one another. For that purpose, a thin shell material will preferably be used. Materials entering into consideration are, for example, plastic or light metal, e.g., a plastic-coated aluminum alloy.

The inventive ski boot requires a special inner boot 128 which is stretchable and exerts no unpleasant inside pressure on the foot. Such an inner boot 128 may be made of an elastic textile material. The material is preferably of multilayer quilted construction, the outer layers being of knitted fabric with insulating padding of cotton, polyester, or the like between them. The inner boot 128 made of this material is at least partially coated, preferably only up to the ankle, with a waterproof material. At the toe and heel there are plastic flaps which can fit into openings 48 and 49 of the outer boot and remain in the same position also during fitting. In addition, the inner boot 128 is also attached to the top edge of the adjustable upper heel shell. Furthermore, the inner boot 128 has conventional padding near the top of the upper heel shell. Preferably, the inner boot 128 has no tongue since the closure flap of the ski boot has the necessary adjustable padding.

FIGS. 3-5 illustrate another embodiment of the inventive ski boot, FIG. 3 being a side elevation, FIG. 4 a rear elevation, and FIG. 5 a perspective view. This boot has four sole blocks, viz., rear sole blocks 101 and front sole blocks 102, on which four outer boot shell parts 103, 104, 105, and 106 are disposed. The front and rear shell parts are joined by intermediate shell pieces 107 and 108 connected to the shell parts by adjustable attachment means. An upper heel shell 109 is tiltably joined to lower heel shells 103 and 104 at hinge locations 110. A particularity is that the upper heel shell is laterally extended toward the front. Situated in the entry opening is wellpadded tongue 111, which is connected, tiltably forward, to the outer boot by means of a tongue bow 112, which is pressed against the skier's foot. Tongue bow 112 is fastened movably in a hole 113 in one or both front shell parts. A number of adjustment and attachment straps 114 for tongue 111 are transversely disposed o bow 112. These straps are preferably made of a nylon material with a fastener made of pressure-adhering synthetic material of the type sold under the registered trademark VELCRO. It is thereby possible for the tongue bow 112, together with these adjustment and attachment straps 114, to exert pressure upon tongue 111. By tightening straps 114, pressure on the foot, especially on the instep, can be increased. Attachment bow 112 has a stud 115 which can be engaged by a fastening lever 116. The ski boot has at least one fastening lever which engages stud 115 of bow 112 by means of a partial rotational movement. Lever 116 is attached by an attachment screw 117 which simultaneously serves as the axis of rotation for the clasp.

Further affixed to fastening lever 116 at the rear is an adjusting lever 118. This lever is attached by means of a hinge 119 and can snap into several catch openings upon rotation. In this way, two positions in particular are possible, viz., a right-angle position and a straight one. In the straight position, lever 118 has no further influence upon the boot. If lever 118 is flipped over toward the heel of the boot at a right angle to fastening lever 116, lever 118 engages a device by means of which the boot can be set in a walking and riding position. This device consists of a housing 120 for the adjusting mechanism, including a pin disposed in a spiral spring in such a way that when adjusting lever 118 is in a position between the pin and a counterbearing 121, a rearward movement of the upper heel shell relative to the rest of the outer boot is no longer possible. Counterbearing 121 has a setscrew 122, whereby precise fixing of the upper heel shell is possible in co-operation with adjusting lever 118. The arrangement described makes it possible for the skier to release the locking of the upper heel shell easily while skiing or while standing in line at a ski-lift. This released position also facilitates walking in the ski boot, whereas during skiing there is only a limited possibility of movement. In particular, no movement to the rear is possible.

The upper heel shell further comprises bent flaps 123 for holding tongue bow 112. These flaps are disposed on both sides of the upper heel shell next to tongue 111. Spreading bow 112 apart allows it to be snapped into flaps 123. Furthermore, as a result of the co-operation between tongue bow 112 and bent flaps 123, additional pressure is exerted on tongue 111 during a forward-leaning skiing posture in that tongue bow 112 is pressed downward by the front part of the upper heel shell. In this way, the foot obtains a particularly firm seating when pressure is exerted on the ski, which makes possible extraordinarily precise guidance of the skis at the right moment.

Furthermore, setscrews 124 for adjusting the width of the ski boot are shown in FIGS. 3-5. At the front of sole blocks 102 are coupling surfaces 125, and on rear sole blocks 101 coupling surfaces 126. These surfaces may engage directly in a ski binding or may be provided with coupling pieces which allow the boot to be utilized in a standardized binding.

Additional elucidation is provided by FIG. 4; in which the reference numerals are the same as those for the parts already mentioned in connection with FIG. 3. FIG. 4 shows clearly how adjusting lever 118 engages between the pin in housing 120 and part 122, which serve to lock the upper heel shell relative to the rest of the outer boot. In the setting depicted, the upper heel shell is locked, whereas in the opened position the upper heel shell can be slightly tilted; a relaxed manner of skiing, on the one hand, and easier walking, on the other hand, are thereby made possible.

From FIG. 5, a perspective view, particularly the arrangement of tongue bow 112 and its engagement in bent flaps 123 are clearly apparent. The tongue (111, not shown) is disposed under straps 114. Depending upon the shape and size of the ski boot, fastening straps 114, made of pressure-adhering synthetic material of the type sold under the registered trademark VELCRO, may be tightened or loosened. This illustration further makes it comprehensible that when the upper heel shell is tilted, tongue bow 112 is pressed downward in the vicinity of its front attachment, causing pressure on the foremost fastening strap 114, which transmits this pressure to the tongue. As in the embodiments previously described, sealing of the outer boot is not necessary since a fitted water-tight inner boot is provided. It is expressly pointed out that additional adjustment and attachment straps for the tongue may be disposed on tongue bow 112. Depending upon the design and thickness of the tongue, the ski boot can be adapted to the needs of the skier.

What is claimed is:

1. A size-adjustable ski boot of the type comprising an outer boot and an inner boot, said outer boot including a shell, an upper heel shell, a sole, and a fastening means, wherein the improvement comprises:

a said shell divided by first and second planes into four shell parts separated from each other at said planes, said planes being normal to the plane of said sole, said first plane being normal to the axis of said sole and said second plane running parallel to said axis;

a said sole divided in the same way as said shell; and adjusting means holding said shell parts and sole parts together in such a way as to enable longitudinal and transverse adjustment of said ski boot.

2. The ski boot of claim 1, wherein said shell parts overlap at least partially at lines bordering one another.

3. The ski boot of claim 1, wherein the inner boot is made of a water tight material.

4. The ski boot according to claim 1, wherein said inner boot is made of a water tight elastic material for adapting to the size of the wearer's foot.

5. The ski boot of claim 4, wherein said elastic inner boot is fixed to a front, a rear, and a top portion of said upper heel shell.

6. A size-adjustable ski boot of the type comprising an outer boot and an inner boot, said outer boot including a shell, an upper heel shell, a sole, and a fastening means, wherein the improvement comprises:

a said shell divided by first and second planes into four shell parts, said planes being normal to the plane of said sole, said first plane being normal to the axis of said sole and said second plane running parallel to said axis;

a said sole being independent of said shell, said shell being adjustably mounted on said sole; said sole being divided into a front sole part and a rear sole part, further comprising means for longitudinally and adjustably connecting said sole parts, whereby the length of said sole can be set to correspond to the length of said shell; and adjusting means holding said shell parts and sole parts together in such a way as to enable longitudinal and transverse adjustment of said ski boot.

7. The ski boot of claim 6, wherein said shell parts overlap at least partially at lines bordering on one another.

8. The ski boot of claim 6, wherein said inner boot is water-tight.

9. The ski boot of claim 6, wherein said inner boot is made of water tight elastic material for adapting to the size of the wearer's foot.

10. The ski boot of claim 6, wherein elastic inner boot is fixed to the front, the rear, and the top of said upper heel shell.

11. A size-adjustable ski boot comprising an outer boot and an inner boot, said outer boot including a shell, an upper heel shell, a sole, fastening means, a tongue, a tongue bow having a closed shape corresponding to the outline of said tongue and including at least one stud, and a plurality of straps provided with pressure-type fasteners and embracing said tongue bow, whereby the pressure of said tongue on the wearer's foot can be regulated, said fastening means comprising at least one fastening lever secured to said shell and including a hook adapted to engage said stud, wherein said shell is divided by first and second planes into four said shell parts, said planes being normal to the plane of said sole, said first plane being normal to the axis of said sole substantially midway between the heel part and the toe of said ski boot, and said second plane running parallel to the plane of said sole along said axis.

12. The ski boot of claim 11, wherein said fastening lever is pivotingly secured to the outside of said upper heel shell and rotates about an axis aligned substantially parallel to the plane of said sole and normal to the axis of said sole.

13. The ski boot of claim 12, further comprising a second lever disposed at one end of said fastening lever and a device secured to said shell and to said upper heel shell for limiting rearward tilting, wherein said fastening lever has at least one supplementary function for arresting the forward-leaning posture, said second lever snapping toward said upper heel shell into said device when said ski boot is closed, whereby the tilting movement of said upper heel shell is limited rearward.

14. The ski boot of claim 12, wherein said tilting upper heel shell includes on the side thereof remote from said fastening lever and immediately next to the entry opening of said ski boot a plurality of hook-shaped flaps for engaging said tongue bow.

* * * * *